United States Patent [19]

Sherwood et al.

[11] Patent Number: 4,867,945

[45] **Date of Patent: * Sep. 19, 1989**

[54] METHOD OF INHIBITING THE CORROSION OF COPPER AND COPPER ALLOYS

[75] Inventors: Nancy S. Sherwood, Coraopolis; Nicholas J. Alfano, Pittsburgh, both of Pa.

[73] Assignee: Calgon Corporation, Pittsburgh, Pa.

[ * ] Notice: The portion of the term of this patent subsequent to Mar. 17, 2004 has been disclaimed.

[21] Appl. No.: 107,837

[22] Filed: Oct. 13, 1987

Related U.S. Application Data

[63] Continuation of Ser. No. 892,635, Aug. 4, 1986, Pat. No. 4,717,543.

[51] Int. Cl.[4] ..... C23F 11/173

[52] U.S. Cl. ..... 422/16; 210/701; 252/180; 252/391; 422/17

[58] Field of Search ..... 210/700, 701; 252/180, 252/181, 389.2, 391, 395; 422/15–17

[56] References Cited

U.S. PATENT DOCUMENTS

| | | | |
|---|---|---|---|
| 3,898,037 | 8/1975 | Lange et al. | 252/395 |
| 3,928,196 | 12/1975 | Persinski et al. | 252/180 |
| 3,941,562 | 3/1976 | Hollingshad | 422/16 |
| 4,358,355 | 11/1982 | Kalu et al. | 525/293 |
| 4,526,728 | 7/1985 | Finke et al. | 210/700 |
| 4,552,665 | 11/1985 | Ralston | 210/697 |
| 4,650,591 | 3/1987 | Boothe et al. | 422/16 |

FOREIGN PATENT DOCUMENTS

| | | | |
|---|---|---|---|
| 89654 | 9/1983 | European Pat. Off. . | |
| WO-83/02628 | 8/1983 | PCT Int'l Appl. | 252/389.2 |

*Primary Examiner*—Peter Hruskoci

*Attorney, Agent, or Firm*—W. C. Mitchell; M. C. Sudol, Jr.

[57] ABSTRACT

The present invention is directed to a method of inhibiting the corrosion of copper and copper alloys in an aqueous system containing oxygen using an effective amount of a polymer prepared from:

(A) about 30 to about 70%, by weight, of acrylic acid or methacrylic acid;

(B) about 30 to about 70%, by weight, of 2-acrylamido-2-methylpropylsulfonic acid or 2-methacrylamido-2-methylpropylsulfonic acid; and (C) about 15 to about 25%, by weight, of 2-acrylamido-2-methylpropylphosphonic acid or 2-methacrylamido-2-methylpropylphosphonic acid, acrylamide or methacrylamide; wherein the polymer has an intrinsic viscosity of from about 0.05 to about 4.5 dl/g, in 1.0 M NaCl.

2 Claims, No Drawings

METHOD OF INHIBITING THE CORROSION OF COPPER AND COPPER ALLOYS

This is a continuation of application Serial No. 892,635, filed August 4, 1986, now Pat. No. 4,717,543.

BACKGROUND OF THE INVENTION

U.S. Pat. Nos. 3,928,196 and 4,552,665 disclose the use of 2-acrylamido-2-methylpropylsulfonic acid (hereinafter "AMPSA")/acrylic acid copolymers as scale inhibitors.

U.S. Pat. 4,526,728 discloses the use of 2-acrylimido-2-methylpropylphosphonic acid (hereinafter AMPPA)-/acrylic acid copolymers as scale inhibitors. Published European Patent Application 89,654 discloses the use of copolymers of 2-acrylamido-2-methylpropylphosphonic acid and acrylamide or acrylic acid as scale inhibitors.

This invention relates to the inhibition of copper corrosion in systems which contain oxygen-bearing waters.

More particularly, this invention relates to the use of specified low molecular weight polymers to inhibit the corrosion of copper and copper alloys which are in contact with oxygen-bearing waters.

Oxygen corrosion is, of course, a serious problem in any copper-containing water system. The inventors have discovered novel corrosion inhibitors which inhibit oxygen corrosion in water systems containing oxygen which are in contact with copper and copper alloys.

DESCRIPTION OF THE INVENTION

The instant invention is directed to a method of inhibiting the corrosion of copper and copper alloys in an oxygen-containing aqueous system, comprising adding to the system an effective amount of a polymer having an intrinsic viscosity of from about 0.05 to about 4.5 dl/g, in 1.0 M NaCl, comprising:

(A) about 30 to about 70%, by weight, of acrylic acid or methacrylic acid;

(B) about 30 to about 70%, by weight, of 2-acrylamido-2-methylpropylsulfonic acid or 2-methacrylamido-2-methylpropylsulfonic acid; and (C) about 15 to about 25%, by weight, of a monomer selected from the group consisting of acrylamide, methacrylamide, 2-acrylamido-2-methylpropylphosphonic acid and 2-methacrylamido methylpropylsulfonic acid.

The inventors have surprisingly found the above defined polymers to be effective copper corrosion inhibitors. Additional polymers were screened, and were not found to be effective.

These polymers are prepared using about 30 to about 70%, preferably 35 to 45%, by weight, acrylic acid or methacrylic acid, preferably acrylic acid; about 30 to about 70%, preferably 35 to 45%, by weight, 2-acrylamido-2-methylpropylsulfonic and (hereinafter "AMPSA") or 2-methyacrylamido-2-methylpropylsulfonic acid, preferably AMPSA; and about 15 to about 25%, preferably 18 to 22%, by weight, acrylamide, methacrylamide, 2-acrylamido-2-methylpropylphosphonic acid (hereinafter AMPPA") or 2-methacrylamido-2-methylpropylphosphonic acid. Though additional monomers may also be used, terpolymers are preferred. AMPPA may be prepared as described in U.S. Patent 4,526,728.

An effective amount of each of the instant polymers is required. As used herein, the term "effective amount" refers to that amount of polymer which effectively retards copper corrosion in a given aqueous system. The inventors have found that the effective amount for a polymer of this invention varies depending upon the monomer used as component C, as described in detail later in this specification.

The instant polymers may be prepared by mixing the monomers, preferably in the presence of a free radical initiator. Any free radical initiator may be used. Examples include peroxides, azo initiators and redox systems. The polymerization may also be initiated photochemically. The preferred catalysts are sodium persulfate or a mixture of ammonium persulfate and any azo type initiator, such as 2,2'-azobis-(2,4-dimethyl-4-methoxyvaleronitrile). The polymerization may be conducted by any of a varity of procedures. For example, solution, suspension or bulk emulsion polymerization techniques may be used.

The reaction temperature is not critical. The reaction will generally occur between 10 and 100° C., preferably 40 to 60° C. It is generally impractical to run the reaction below room temperature because the reaction is too slow. Above a temperature of 60° C., the molecular weight of the polymer tends to decrease. The reaction, depending on the temperature, generally takes from 1 to 12 hours. Measuring for residual monomer will verify when the reaction is complete.

The pH of the reaction mixture is not critical. The pH is generally in the range of 3.5 to 9.0.

The precent solids in the reaction mixture is not critical. The preferred range is 1 to 50%, by weight, solids.

The molecular weights of the instant polymers are difficult to accurately measure. The polymers are, instead, usually identified by intrinsic viscosity. The intrinsic viscosity should be from about 0.05 to about 4.5, preferably about 0.5 to about 2.5 dl/g, in 1.0 M sodium chloride (measured on a 75 Cannon Ubbelohde capillary viscometer).

While the polymers of the instant invention have been found to be effective as copper and copper alloy corrosion inhibitors, they may be used in combination with other scale inhibitors (such as phosphonates) or with other corrosion inhibitors (such as zinc or triazoles) known in the art.

The Applicants have found that the required effective dosage varies with respect to the polymer used. Thus, polymers which contains AMPPA or methAMPPA as monomer (C) are effective at dosages of from about 0.1 to about 10 mg/l, preferably about 1.0 to about 10 mg/l active, while polymer which contain acrylamide or methacrylamide as monomer (C) perform best at dosages of greater than about 5.0 mg/l active, preferably about 5.0 to about 30 mg/l.

The instant polymers can be used as water treatment additives for industrial cooling water systems, gas scrubber systems or any water system which contains copper and/or copper alloys. They can be fed alone or as part of a treatment package which includes, but is not limited to, biocides, scale inhibitors, dispersants, defoamers and other corrosion inhibitors.

EXAMPLES

The following examples demonstrate the effectiveness of the instant polymers as copper and copper alloy corrosion inhibitors. They are not, however, intended to limit the scope of the invention in any way.

The test apparatus used was an 8-liter cell which had automatic temperature and pH control. Two test environments were studied, each of which exposed the polymers being tested to different levels of corrosivity. The first environment tested was 4×cycles of concentration of Pittsburgh tap water at pH 8.5 and 50° C. and the second environment tested was 3%, by weight, NaCl in distilled water at pH 7.0 and room temperature. 4×cycles of concentration of Pittsburgh tap water contains approximately 24 mg/l $Mg^{+2}$, 325 mg/l $SO_4^{-2}$, 40 mg/l $HCO_3^-$, 88 mg/l $Ca^{+2}$, 70 mg/l $Cl^-$ and 71 mg/l $Na^+$. Constant aeration was provided via sparger tubes and the system was entirely closed, allowing for little evaporation.

The test consisted of immersing two Admiralty 443 coupons in the test cell for seven days and then calculating the gravometric corrosion rate. The coupons measured approximately 3"×½×1/16", so that the surface area was known prior to immersion. The following cleaning procedure was used:

1. Each coupon was dipped in a copper cleaning solution (5:4:1 ratio of HCl/deionized water/$H_2SO_4$) for a maximum of five seconds;

2. Each coupon was then immersed separately in Calclean (a sodium metasilicate industrail cleaning solution, commercially available from Calgon Corporation, Pittsburgh, Pennsylvania), deionized (DI) water, and acetone until a "sheeting" action was produced on the surface of the coupon; and 3. Each coupon was air dried.

Each coupon was then weighed accurately to five decimal places and immersed for seven days in the test solution. Tables 1 and 2 show the treatement levels used in this study and the corresponding percent corrosion inhibition values. Control samples were tested to establish a base corrosion rate which was used to gauge the performance of the compounds. After immersion, the coupons were again cleaned using the above defined procedure and a final weight was taken to calculate the percent corrosion inhibition values.

TABLE 1

Corrosion Rates of Admiralty 443[1] Coupons in 4 × Pittsburgh Tap Water (pH = 8.5; 50° C.; Seven Day Immersion)

| EXAMPLE | POLYMER* (Weight percent monomer) | DOSAGE (mg/l) | % CORROSION INHIBITION |
|---|---|---|---|
| 1 | AA[2]/AMPSA[3]/AMPPA[4] (40/40/20) | 1.0 | 87.6 |
| 2 | AA/AMPSA/AMPPA (40/40/20) | 10.0 | 86.0 |
| 3 | AA/AMPSA/AMPPA (40/40/20) | 30.0 | 30.1 |
| 4 | AA/AMPSA/AM[5] (40/40/20) | 1.0 | 34.8 |
| 5 | AA/AMPSA/AM (40/40/20) | 5.0 | 74.0 |
| 6 | AA/AMPSA/AM (40/40/20) | 10.0 | 88.8 |

TABLE 1-continued

Corrosion Rates of Admiralty 443[1] Coupons in 4 × Pittsburgh Tap Water (pH = 8.5; 50° C.; Seven Day Immersion)

| EXAMPLE | POLYMER* (Weight percent monomer) | DOSAGE (mg/l) | % CORROSION INHIBITION |
|---|---|---|---|
| 7 | AA/AMPSA/AM (40/40/20) | 30.0 | 81.7 |

[1]Admiralty 443, by weight, is approximately:
70% copper
29% zinc
0.9–1.2% tin
0.07% max lead;
0.06% max iron;
0.02–0.1% arsenic; and
0.15% max other.
[2]AA is acrylic acid
[3]AMPSA is 2-acrylamido-2-methylpropyl-sulfonic acid, available from The Lubrizol Corporation. ("AMPS" is a registered trademark of The Lubrizol Corporation).
[4]AMPPA is 2-acrylamido-2-methylpropyl-phosphonic acid
[5]AM is acrylamide
*All polymers used had intrinsic viscosities of about 0.11 dl/g in 1.0 M NaCl.

TABLE 2

Corrosion Rates of Admiralty 443[1] Coupons in 3%, by Weight, NaCl Solution

| EXAMPLE | POLYMER* (Weight percent monomer) | DOSAGE (mg/l) | % CORROSION INHIBITION |
|---|---|---|---|
| 8 | AA[2]/AMPSA[3]/AMPPA[4] (40/40/20) | 2.0 | 18.8 |
| 9 | AA/AMPSA/AMPPA (40/40/20) | 10.0 | 31.6 |
| 10 | AA/AMPSA/AM[5] (40/40/20) | 2.0 | No Reduction |
| 11 | AA/AMPSA/AM (40/40/20) | 10.0 | 36.3 |

[1]Admiralty 443 is, by weight, approximately:
70% copper
29% zinc
0.9–1.2% tin
0.07% max lead;
0.06% max iron;
0.02–0.1% arsenic; and
0.15% max other.
[2]AA is acrylic acid
[3]AMPSA is 2-acrylamido-2-methylpropyl-sulfonic acid, available from The Lubrizol Corporation. ("AMPS" is a registered trademark of The Lubrizol Corporation).
[4]AMPPA is 2-acrylamido-2-methylpropyl-phosphonic acid
[5]AM is acrylamide
*All polymers used had intrinsic viscosities of about 0.11 dl/g in 1.0 M NaCl.

What is claimed is:

1. A method of inhibiting copper and copper alloy corrosion in an aqueous system containing oxygen which is in contact with said copper or copper alloy, consisting essentially of adding to said system about 5 to about 30 mg/l of a polymer having an intrinsic viscosity of 0.05 to 2.5 dl/g in 1.0 NaCl, which comprises:

(A) about 35 to about 45%, by weight, of acrylic acid or methacrylic acid or methacrylic acid;

(B) about 35 to about 45%, by weight, of 2-acrylamido-2-methylpropylsulfonic acid or 2-methacrylamido-2-methylpropylsulfonic acid; and (C) about 18 to about 22%, by weight, of acrylamide or methacrylamide.

2. The method of claim 1, wherein said polymer is prepared from acrylic acid, 2-acrylamido-2-methylpropylsulfonic acid and acrylamide.

* * * * *